US005427423A

United States Patent [19]

Georgopoulos

[11] Patent Number: 5,427,423

[45] Date of Patent: Jun. 27, 1995

[54] PADLOCK SECURITY SEAL WITH INTERNAL BAR CODE

[75] Inventor: George Georgopoulos, Pine Brook, N.J.

[73] Assignee: E. J. Brooks Company, Newark, N.J.

[21] Appl. No.: 127,950

[22] Filed: Sep. 27, 1993

[51] Int. Cl.[6] ..... B65D 33/34

[52] U.S. Cl. ..... 292/320; 292/307 R; 40/661

[58] Field of Search ..... 292/307 R, 307 A, 319, 292/323, 320; 40/661, 665; 24/704.1, 704.2

[56] References Cited

U.S. PATENT DOCUMENTS

| | | | |
|---|---|---|---|
| 1,132,970 | 3/1915 | Peyton | 292/307 R |
| 3,485,521 | 12/1969 | Moberg . | |
| 4,389,063 | 6/1983 | Ryan | 292/307 R |
| 4,733,893 | 3/1988 | Davis et al. | 292/320 |
| 4,782,613 | 11/1988 | Guiler et al. | 40/665 |
| 4,832,387 | 5/1989 | Guiler . | |
| 4,836,590 | 6/1989 | Swift | 292/320 |
| 4,887,855 | 12/1989 | Tritton et al. | 292/307 R |
| 4,893,853 | 1/1990 | Guiler . | |
| 4,909,552 | 3/1990 | Weber et al. | 292/320 |
| 5,120,097 | 8/1992 | Fattori et al. | 292/307 A |
| 5,214,871 | 6/1993 | DiCataldo, Sr. | 40/649 |

FOREIGN PATENT DOCUMENTS

| | | | |
|---|---|---|---|
| 1203734 | 9/1970 | United Kingdom | 40/661 |

*Primary Examiner*—Peter M. Coumo
*Assistant Examiner*—Darnell M. Boucher
*Attorney, Agent, or Firm*—William Squire

[57] ABSTRACT

A molded rectangular plastic body in one embodiment is formed with a shallow depth rectangular chamber in which an insert is inserted. The insert takes up the full width, depth and length of the chamber and comprises a relatively thin molded plastic sheet. A plurality of thin walls upstand from one side of the sheet to form a plurality of chambers with the body. A shackle formed of resilient wire has two legs each with a reversely bent end portion. Each leg is inserted into and lockable in a different chamber. A bar code label or bar code indicia is adhered to or imprinted on a side of the insert opposite the locking chambers and recessed in the insert. The indicia is surrounded by a wall which is welded to the body to seal the indicia. The body is transparent so the bar code is externally readable. The insert may be opaque to provide seal identity classification by color coding the insert. In a second embodiment, no insert is used, the body being formed of two halves, one of which receives the bar code indicia and the other being formed with leg receiving and locking channels, the indicia being internal the body when the halves are attached.

26 Claims, 4 Drawing Sheets

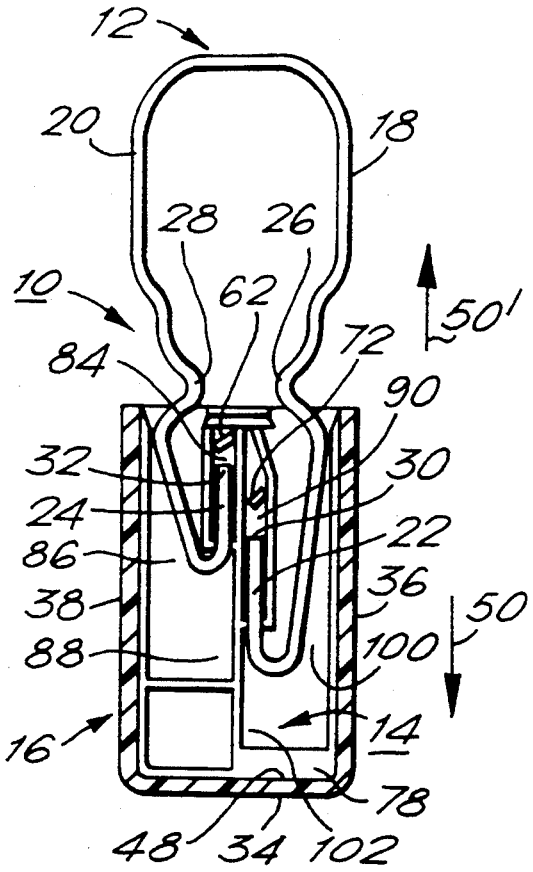
FIG. 4.
FIG. 5.
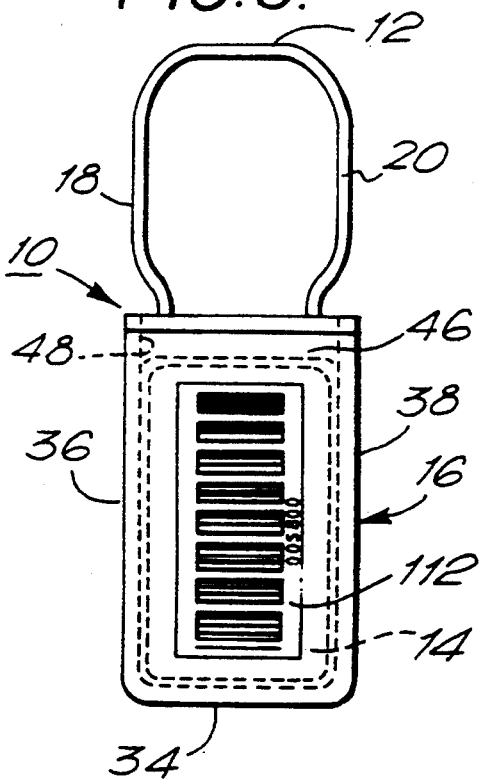
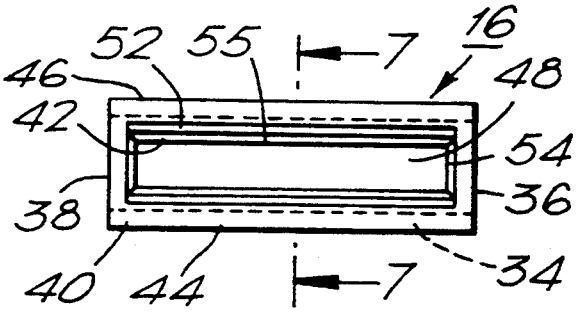
FIG. 6.
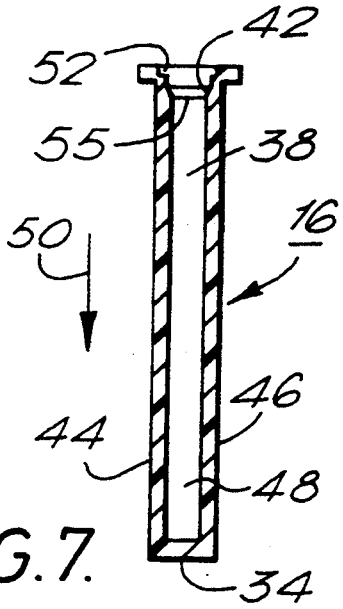
FIG. 7.

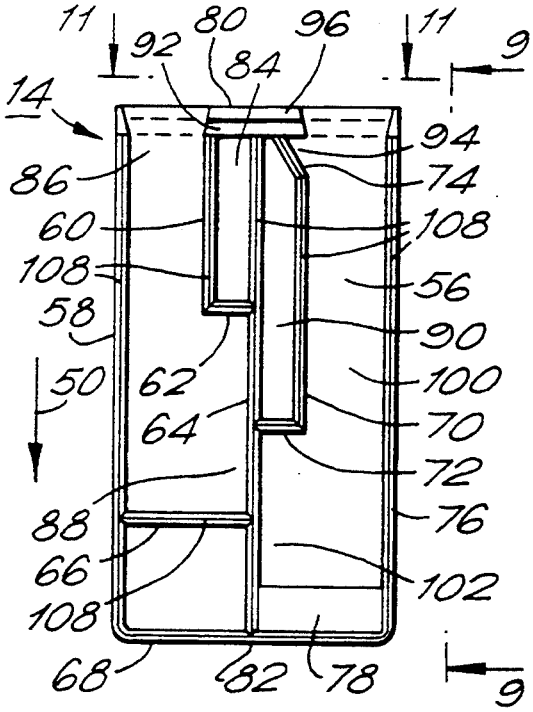
FIG. 8.
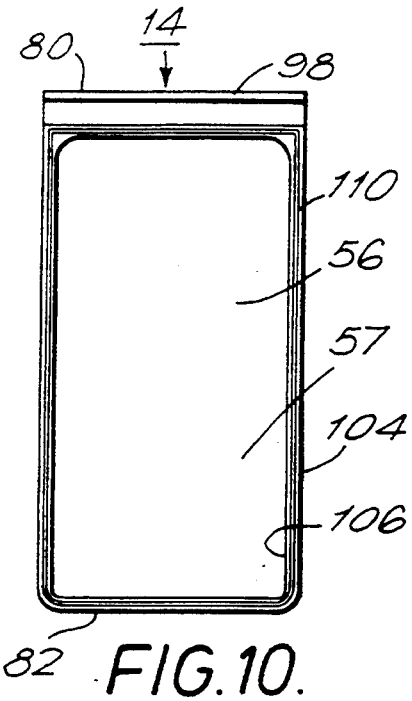
FIG. 10.
FIG. 9
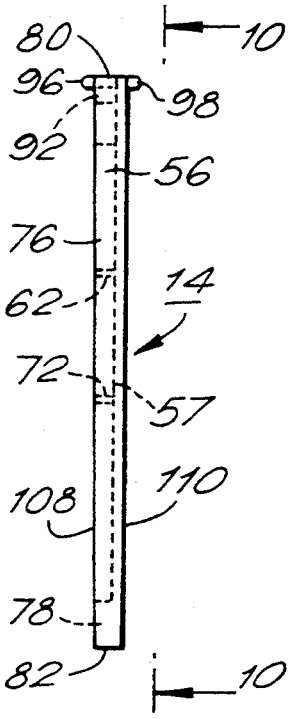
FIG. 12.
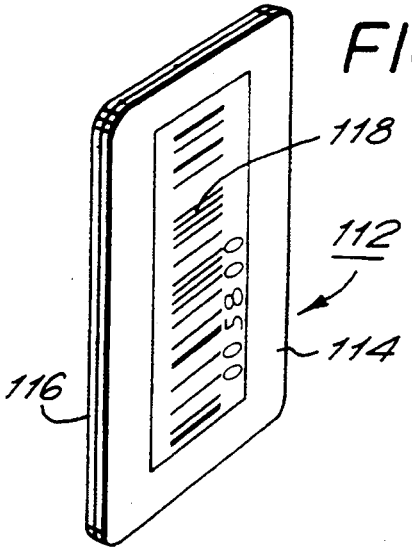
FIG. 11.
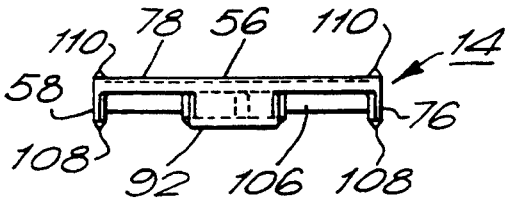

PADLOCK SECURITY SEAL WITH INTERNAL BAR CODE

This invention relates to security seals of the padlock type, and more particularly, to seals with locking inserts for securing a resilient shackle thereto of the type having reversely bent locking leg portions.

Of interest is commonly owned application Ser. No. 08/023,576 entitled Padlock-Type Security Seal having a Locking Insert fixed in a Hollow Body and Method of Making Same filed Feb. 26, 1993 in the name of Georgopoulos et al now U.S. Pat. No. 5,314,219.

Security seals of the padlock type are well known and are in wide spread use for sealing currency bags, closures, electric meters and so on. Examples of such seals are shown in the following U.S. Pat. Nos.: 3,485,461, 3,373,033, 3,980,332, 4,353,583, 4,278,281, 4,687,240, 4,832,387, 4,893,853 and 4,775,175.

In certain of the above, the seals employ locking inserts which are insertable into a body cavity. Examples include the aforementioned copending application and the '853 and '387 patents. These seals work well. However, in use the seals are identified with unique bar code numbers to trace the individual seals in transport, for example. The bar code is placed on the seal exterior. This creates a problem in that the bar code during use of the seal tends to rub off and become illegible. The present inventor recognizes a need to provide a more durable bar code marking which will survive extensive use of the seals.

A padlock type security seal according to one embodiment of the present invention comprises a shackle having at least one leg with a resilient reversely bent leg end portion forming a locking element. A transparent body has a first chamber therein in communication with the ambient atmosphere through an opening in the body in an axial direction. The chamber has a given depth, width and length in the axial direction. A locking insert is secured to the body in the chamber, the insert comprising a rear wall with opposing: broad sides and a plurality of side walls upstanding from one of the opposing broad sides to form a further chamber with the body in communication with the opening for receiving the at least one leg and to form a locking chamber in communication with the further chamber for receiving and locking the reversely bent leg portion therein. The rear wall on a side opposite the upstanding walls comprises a planar surface of sufficient continuous planar area for receiving bar code indicia thereon, the insert occupying the body chamber width, depth and length. As a result, the bar code is protected from wear inside the body chamber.

In accordance with a further embodiment, the bar code indicia is hermetically sealed inside the body, According to a still further embodiment, a padlock security seal comprises a shackle having at least one leg with a resilient reversely bent leg end portion forming a locking element. A body has a first chamber extending in an axial direction and of a given transverse depth with an opening at one body end, the body comprising first and second major opposing walls of broad surface area relative to said depth, at least one of the opposing walls being transparent. A plurality of side walls extend from and between the major walls in the first chamber for dividing the first chamber into at least one subchamber. The at least one subchamber forms a leg receiving chamber in communication with the at least one opening for receiving the at least one leg through the opening and a locking chamber in communication with the leg receiving chamber for receiving and locking the reversely bent leg portion therein. Bar code indicia are in the first chamber adjacent to the transparent one major wall and visible through the one transparent major wall external the first chamber

IN THE DRAWING

FIG. 4 is a sectional elevation view similar to that of FIG. 3 wherein an attempt has been made to remove the shackle;

FIG. 5 is a view similar to that of FIG. 3 on the obverse side of the seal illustrating the bar code visible through the body;

FIG. 6 is a plan view of the body of the seal of FIG. 1;

FIG. 7 is a sectional view taken along lines 7—7 of FIG. 6;

FIG. 8 is a front elevation view of the insert of FIG. 1 shown in more detail;

FIG. 9 is a side edge elevation view of the insert of FIG. 8 taken along lines 9—9;

FIG. 10 is a rear elevation view of the insert taken along lines 10—10 of FIG. 9;

FIG. 11 is a plan view of the insert of FIG. 8 taken along lines 11—11;

FIG. 12 is an isometric view of the bar code label of FIG. 5 prior to attachment to the insert of FIG. 10;

Figure 1:
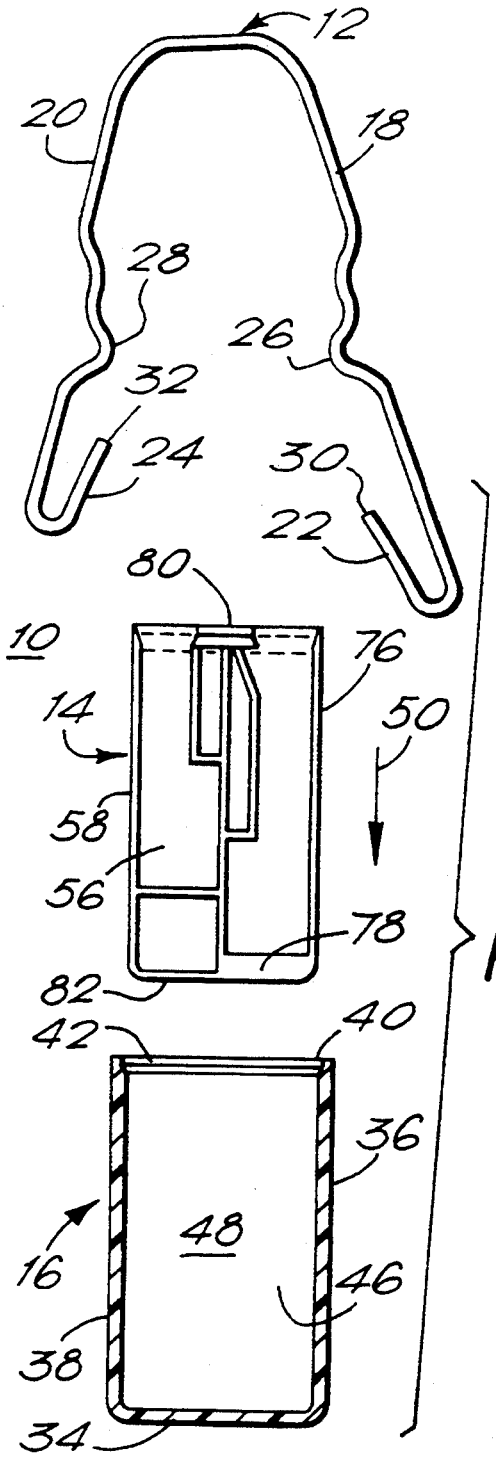
FIG. 1 is an exploded view of a padlock security seal according to one embodiment of the present invention.

In FIG. 1, security seal 10 has a resilient shackle 12, a seal body 16 and an insert 14. The shackle 12 is formed of resilient spring wire, is generally U-shaped with a long leg 18 and a short leg 20. Legs 18 and 20 each have a reversely bent end portion 22 and 24, respectively. Legs 18 and 20 are also formed with anti-picking bumps 26 and 28, respectively. The portions 22 and 24 have relatively blunt ends 30 and 32, respectively.

The body 14 is molded transparent thermoplastic formed into a flat generally rectangular structure having a relatively narrow bottom wall 34 and opposite side walls 36 and 38, FIG. 6 and top wall 40 formed with a slit-like opening 42 therein. The narrow walls are joined by relatively broad respective front and rear walls 44 and 46 to form a chamber 48 which is generally rectangular and relatively shallow in depth (left to right FIG. 7) as compared to its transverse width (left to right FIG. 1) and to its length in the axial direction, direction 50. For example, the chamber 48 may be 0.1 inches (2.5 mm) deep by 0.7 inches (17.5 mm) wide and 1.4 inches (35 mm) long. The body walls may be for example a uniform thickness of about 0.060 inches (1.5 mm).

Opening 42 is formed by a stepped shoulder 52, FIG. 7 in each of the front and rear walls 44 and 46 and shoulder 54 in the side walls 36 and 38 forming an enlarged opening 42 as compared to the transverse dimensions of the chamber 48. A tapered edge portion 55 couples shoulders 52 and 54 into the chamber 48 to permit easy insertion of insert 14 into the chamber 48 in direction 50. The chamber 48 is of uniform depth throughout.

Figure 3:
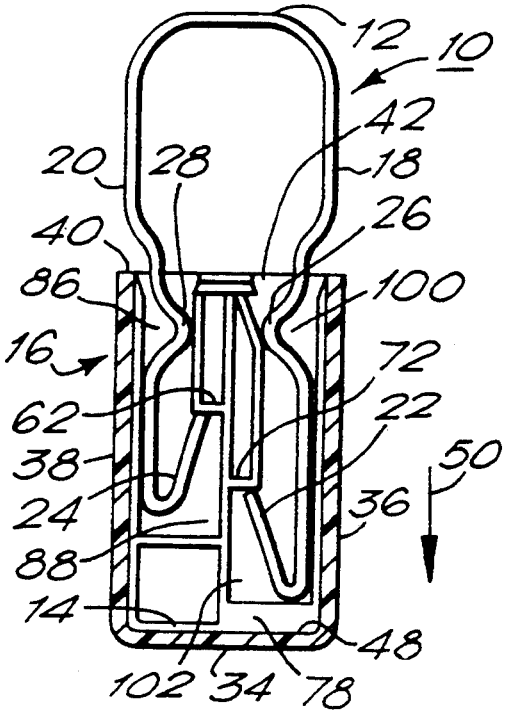
FIG. 3 is a sectional elevation view of the seal of FIG. 2 in a locked mode.

Insert 14, FIGS. 8–11, comprises molded thermoplastic preferably opaque of a uniform color, eg., white or any other color to provide color identification to the seal 10. The colors may be used to identify the seal by product, user or any other desirable utility. The insert 14 is formed with a generally rectangular wall 56 which is of uniform thickness and relatively thin, eg., 0.030–0.040 inches (0.75–1 mm). A plurality of generally linear walls 58–78 upstand from the same front side of wall 56. These linear walls are slightly tapered in height from rear wall 56 in a direction from the thicker portion at the top 80 of the wall 56 to the thinner portion at the bottom 82 of wall 56. The walls 58–76 are all preferably of the same thickness, e.g., 0.030 inches (0.075 mm). Wall 78 is considerably thicker to provide a stop for shackle leg 18 in the axial direction as seen in FIG. 3.

Walls 58, 60, 64, 70 and 76 are parallel and extend in direction 50. Wall 62 is transverse and connected to walls 58 and 64 approximately $\frac{1}{3}$ from top 80 forming a channel 84. Wall 66 is parallel to wall 62 and is connected to walls 58 and 64 approximately $\frac{3}{4}$ of the axial extent of the insert from top 80. Walls 58, 66 and 60 form a channel 86 for receiving shackle leg 20. Walls 62, 66 and a portion of wall 64 form a channel 88 which is open on one side to channel 86. Channel 88 forms a locking recess for receiving the resilient reversely bent end portion 24 of the shackle 12 when inserted into channel 86 in the axial direction 50.

Wall 72 is transverse to and connected to one end of wall 70 at one wall 72 end and to wall 64 at its other end approximately medially between top 80 and bottom 82. Walls 70, 72 and a portion of wall 64 form a channel 90. Channels 90 and 84 are parallel and are enclosed adjacent to the top 80 by transverse wall 92. Channel 90 is further formed by wall 74 connected between walls 92 and 70. Wall 74 is angled toward wall 64 to form a recess 94 at wall 92.

Wall 92 includes a flange 96 extending outwardly therefrom in the same direction as walls 58–78. A second flange 98 extends from rear wall 56 in the opposite direction. Flange 98 extends for the width of the insert rear wall 56 whereas flange 96 is centrally positioned in the width direction. Walls 76 and 70 form a channel 100 for receiving the long leg 18 of the shackle. Walls 72, 64 and 78 form a locking channel 102 for receiving the reversely bent end portion 22 of leg 18. Channel 102 is open on one side to channel 100. Wall 66 serves as a stop for leg 20 and wall 78 serves as a stop for leg 18 as seen in FIG. 3. Recess 94 is open to channel 100.

The rear side of the insert wall 56, FIG. 10, includes a generally rectangular peripheral upstanding side wall 104 such that the majority of rear wall 56 broad surface 57 lies in a recess 106. The upper edges of the walls 58–76 and 104 further include upstanding triangular ribs 108 and 110, respectively. These ribs are used to ultrasonically attach the insert 14 to the body 16. The ribs 108 extend for the distance from a region adjacent to the top 80 to the bottom 82 of the insert.

Rib 110 is annular the full extent of side wall 104 and extends completely about the surface 57 and recess 106 enclosed by wall 104. When the rib 110 is welded to the body 16 the recess 106 is hermetically sealed to body 16 and is isolated from the ambient atmosphere on the opposite front side of the insert and in the leg receiving channels. This prevents contamination of the recess 106 for reasons to be explained below.

In FIG. 12, a bar code label 112 comprises a paper or foil member 114 with an adhesive backing layer 116. A bar code 118 is formed on the surface of the label in a conventional manner. Label 112 has transverse width and length dimensions generally of that of the recess 106 on the rear of insert 14, FIG. 10. The label 112 may take up the entire recess 106 or a portion thereof.

Because the surface of wall 56 in recess 106 is relatively large and planar, the label 112 sticks readily thereto. Because the surface area of label 112 is relatively large as compared to prior art inserts which have locking grooves therein or are relatively narrow, a bar code of sufficient size can be provided suitable for reading by conventional readers. Prior inserts are too narrow to receive a bar code of sufficient dimension to be reliably read by a reader. Also, the bar code label 112 receiving recess 106 is within and does not protrude above the space enclosed by wall 104. As a result, when inserted by automated machinery, the paper or foil label 112 is not subject to periodic catching during insertion of the insert into the body chamber. The adhesive backing label .would tend to jam such automated machinery if the label so catches during insertion. The insert is tapered as mentioned to permit ready insertion into the body chamber 48.

As shown in FIG. 1, the insert 14 with the label 112 attached is inserted in direction 50 into the body chamber 48 until fully seated. At this time the flanges 96 and 98 seat in the mating recesses formed by shoulders 52 and 54 in the body 16. The tapered edges 56 in the opening 52 assist insertion of the insert. 14 into the chamber 48. The insert 14 width dimension fully takes up the channel 48 width dimension and the upstanding walls 58–78 abut the chamber 48 front broad wall 44 and the rear upstanding wall 104 abuts the chamber 48 rear wall 46. Thus the insert 14 occupies the entire chamber 48 width, depth and length.

With the bar code label 112 secured to recess surface 57, FIG. 10, and the insert welded to the body 16 front wall 44 inside chamber 48, the label 112 is hermetically sealed from the ambient atmosphere. This provides longevity to the bar code 118 regardless the ambient environment.

In the present preferred embodiment, the bar code is on a label which is attached to the insert wall 56. In the alternative, the bar code may be attached directly to the surface 57 of wall 56 in the recess 106 by hot stamping, ink jet printing, laser engraving or other similar means. For this reason, it is especially important that the surface 57 be smooth, planar and of sufficient size to permit such printing thereon. Because of the welding of the rib 110 to the body 16 front wall 44 the bar code so imprinted is protected in the same way as the label 112.

It should be understood that the terms width, depth and length are not intended to imply a rectangular configuration, but may refer to general orthogonal directions having averaged dimensions as might occur in a body 16 which is circular, oval or oblong with rounded one or more ends. For example, the body 16 and insert 14 may have a semicircular bottom 82. Typically, however, the width dimension of chamber 48 is approximately constant throughout notwithstanding some tapering to accommodate molding requirements as illustrated in FIG. 9 for the insert 14 overall thickness.

The shackle 12 is made of wire somewhat larger in diameter than prior art shackles because the bent end portions are blunt and need to have sufficient axial strength to break the walls 62 and 72 as will be described. The shackle 12 may be slightly less in diameter than the thickness of the receiving chambers formed by the insert and body.

In operation, the insert is assembled into the chamber 48, FIG. 1, direction 50 until fully seated. The insert 14 has the label 112 or printed bar code indicia 118 thereon prior to insertion. Because the label is recessed on the insert, the insert readily inserts into the chamber 48 without catching or tearing the label. When fully seated the insert is ultrasonically welded in place to the body via ribs 108 and 110. Bar codes need to have a minimum area in order to be read by conventional readers. Prior art inserts do not provide such an area whereas the recess 106 is more than adequate to provide such an area because the insert fully occupies the body chamber 48 and the recess 106 occupies most of the broad surface area of the insert wall 56.

Because the body 16 is transparent, the bar code 118 is clearly visible through the body 16 rear wall 46 from chamber 48. The body 16 protects the insert and label 112 from deterioration during use. Color coding of the insert permits the user to readily identify the seal in accordance with a user created classification system. Because the insert occupies the entire chamber 48 which is most of the broad area of the body 16, the color of the insert dominates and the color of the body 16 appears to be that of the insert.

Figure 2:
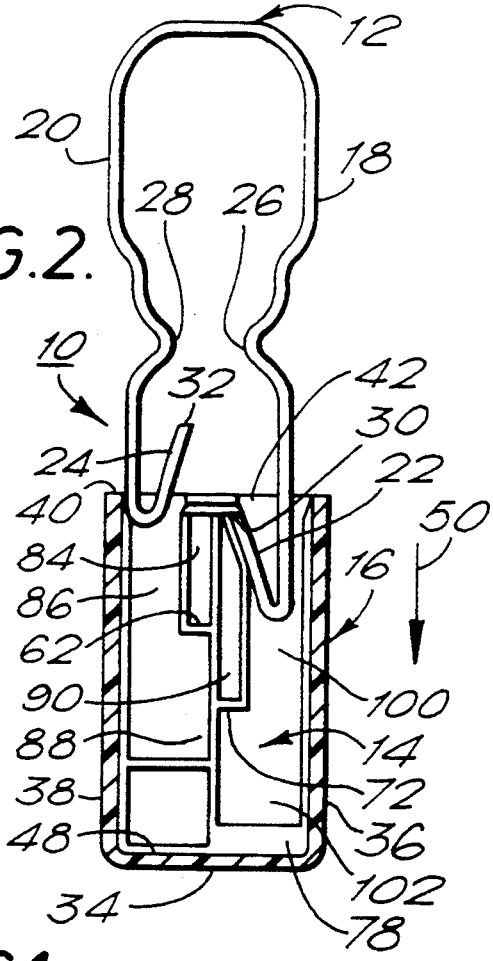
FIG. 2 is a sectional elevation view of the seal of the embodiment of FIG. 1 in a first non-locking stage of use.

With the insert inserted and seated, the shackle is assembled thereto as in FIG. 2 wherein leg 18 bent portion 22 is locked in the recess 94 (FIG. 8). Leg portion 22 can not be removed without damaging the body. The other leg 20 has its tip slightly inserted into channel 86 which forms a chamber with the body as do all of the channels of the insert.

When it is desired to use the seal, the leg 20 is removed from channel 86, threaded through a device to be secured. By squeezing the legs 18 and 20 together, the leg 20 is inserted into the chamber formed by channel 86. The bent end portion 24 resiliently expands and enters the chamber formed by channel 88, FIG. 3. At this time the other leg 18 is in a similar manner is inserted in and locked in the locking chamber of channel 102. The blunt leg end portions at ends 30 and 32 of respective legs 18 and 20 abut the locking walls 72 and 62, respectively.

When the seal is tampered with, the shackle 12 is attempted to be removed in a direction 50' opposite direction 50. When this occurs, the shackle tips at ends 30 and 32 break apart the walls 62 and 72, respectively, and enter the chambers formed by channels 84 and 90. The broken walls 62 and 72 clearly indicate tampering. Any attempt to return the shackle to the position of FIG. 3 will not avoid the indication of tampering because of the ruptured walls 62 and 72 and further, the shackle will be loose. Since the body is transparent, the broken walls are readily evident from one side of the body 16 through wall 44.

It should be apparent, that unlike prior art inserts where the inserts fit in only a portion of the body chamber, the present insert 14 takes up the approximate width, depth and length of the body chamber 48 to provide a relatively broad surface to receive the bar code. This is not practical in the prior art seal devices.

Preferably, the insert width is about 85% of the body width, but may vary from this value in accordance with a given implementation. The body and insert are relatively thin to provide a low cost seal that is attractive, durable and serviceable to a wide variety of needs. The device is made thin to save material and cost. Also, the arrangement of the thin upstanding walls of the insert provide a minimum of heat sinks in the surface of recess 106 on rear wall 56 which sinks may provide a rough surface which detracts from the usefulness of the insert to receive a bar code label or printed indicia thereon. A surface with undulations is not desirable, as the label may not fully adhere to such a surface, especially in an automated process. While relative dimensions have been given herein in an exemplary embodiment, these dimensions are given by way of example and not limitation.

It should be further understood that while a shackle with two legs and corresponding channels are disclosed, a shackle with a single leg formed from a wire whose other end is permanently attached to a support structure may be used. In this case, only a single set of channels such as channels 100 and 102 may be provided the seal structure.

Figure 14:
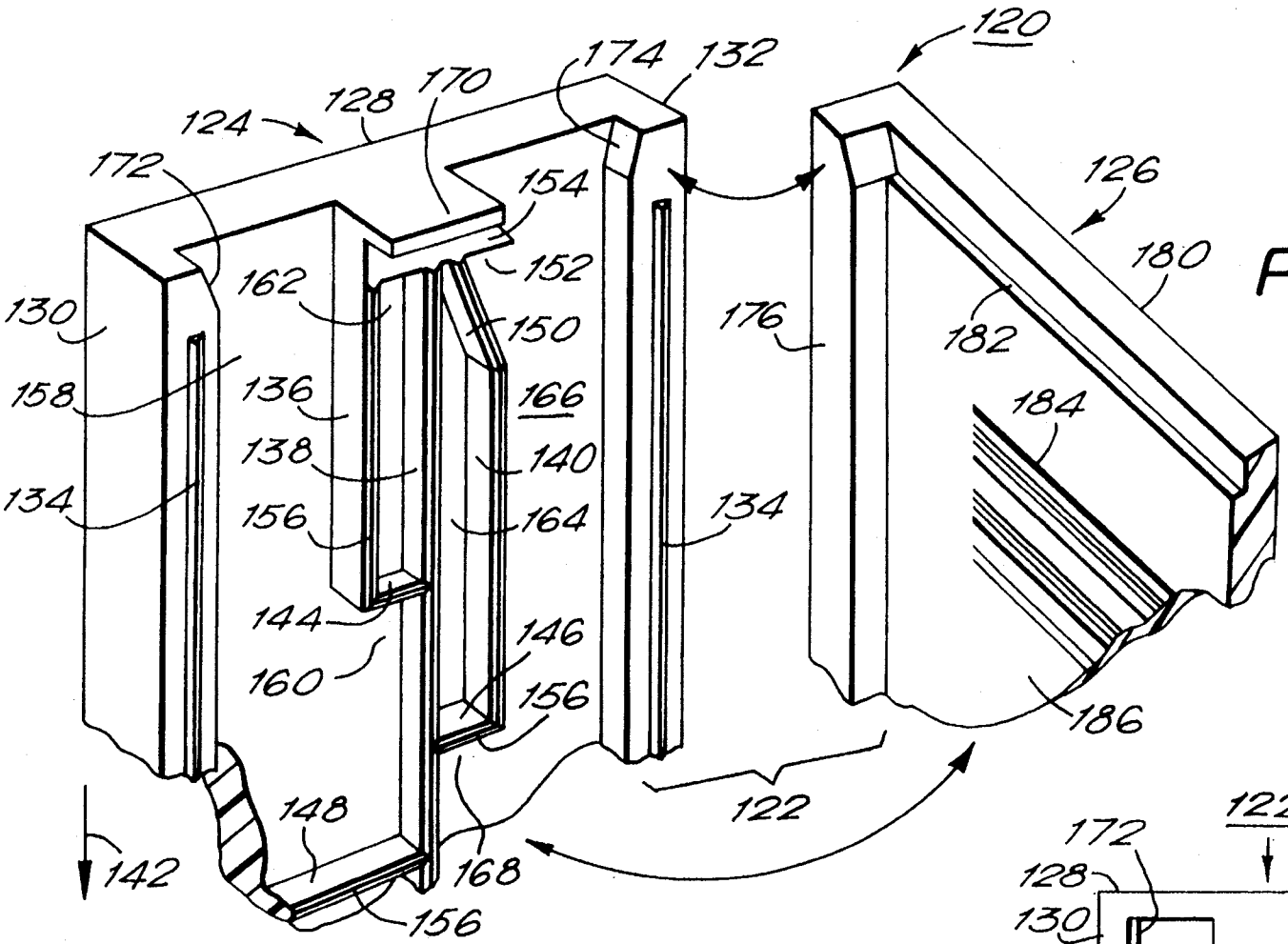
FIG. 14 is an exploded fragmentary view of the seal of FIG. 13.
Figure 13:
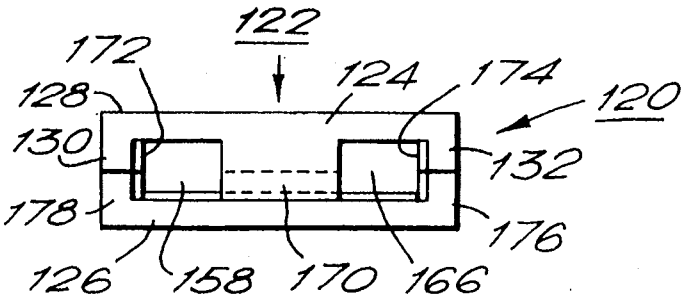
FIG. 13 is a plan view of a seal according to a second embodiment of the present invention.

In FIGS. 13 and 14, a second embodiment of the seal of the present invention is illustrated. Seal 120 comprises molded thermoplastic parts and is shown without the shackle 12 of FIG. 1 for purposes of simplicity of illustration, which shackle is identical to a Shackle for use with seal 120 in an identical manner as described above for use with body 16 and insert 14. Seal 120 comprises a body 122 comprising body portions 124 and 126. Portion 124 includes a rear wall 128 which with upstanding walls to be described combines the function of the body 16 rear wall 46, FIG. 1, with the insert 14 upstanding walls 58–76 and wall 92 and flange 96, FIG. 8. In particular, body portion 124 includes side walls 130 and 132 which are mirror images of each other upstanding from the edges of rear wall 128. Walls 130 and 132 in combination with an upstanding bottom wall (not shown) form a U-shaped wall similar to walls 36, 38 and 34 of body 16, FIG. 1. Walls 130 and 132 upstand from the broad surface of rear wall 128 and are integral therewith. An annular upstanding triangular rib 134 upstands from the walls 130, 132 and the bottom not shown upstanding wall to form a U-shaped rib similar to rib 108 on the periphery of the insert 14, FIG. 8.

A plurality of walls 136, 138 and 140 upstand from wall 128 and extend parallel to walls 132 and 134 in the axial direction 142. These walls correspond in function to walls 60, 64 and 70 of insert 14, FIG. 8. A transverse wall 144 is connected to an end of wall 136 to a medial region of wall 138 and corresponds to wall 62 of insert 14. A second transverse wall 146 is connected to an end of wall 140 and a side of wall 138 opposite wall 144. Wall 146 corresponds to wall 72 of insert 14. Transverse wall 148 corresponding to insert wall 66 is connected to and between walls 130 and 138. A further wall (not shown) corresponding to wall 78 of insert 14 is also included. Walls 136, 138, 140, 146 and 148 are of greater height in the depth direction from wall 128 than walls 130 and 132, these walls not being shown to scale in FIG. 14.

A wall 150, of the same height as wall 140, corresponding to wall 74 is connected to and forms a triangular recess 152 with transverse wall 154 connected at an acute angle to wall 136 at the other end of wall 136 and adjacent an end of wall 138. A triangular upstanding rib is on the upper surfaces of walls 136, 138, 140, 146 and 148 identical to rib 134 which are identical to ribs 108 and 110 of the insert 14. As a result, in plan view looking toward the walls 5130, 132, 136, 138 and so on, the body portion 124 is almost identical to insert 14 notwithstanding the greater thickness of walls 130 and 132 (and the not shown upstanding bottom wall) of portion 124 as compared to the thickness of corresponding insert walls 58, 76 and 68.

Thus, body portion 124 has channels 158–168 corresponding respectively to channels 86, 88, 84, 90, 100 and 102. For example, channel 158 receives shackle 12 leg 20, channel 160 is a locking channel for receiving leg portion 24, channel 166 receives shackle leg 18 and channel 168 is a locking channel for shackle leg portion 22. Walls 144 and 146 respectively rupture when the shackle is attempted to be removed in a direction opposite direction 142. The walls 136, 138, 140, 144, 146, 148, 150 are preferably the same thickness and upstanding heights as the corresponding walls of the insert 14 but without the taper of the insert walls.

Portion 124 wall 154 is wider in direction 142 than the thickness of the walls 136 and so on. A flange 170 projects from the top of the portion 124 and from the wall 154. The walls 130 and 132 include tapered ends 172 and 174 to permit easy insertion of the shackle. The insert 14 includes similar tapers. The sides of flange 170 and wall 154 may also be similarly tapered. Thus the body portion 124 serves the identical shackle locking function of the insert 14 while also providing an external body member to the seal.

The body portion 126 includes side walls 176 and 178 and a bottom wall (not shown) upstanding from a front wall 180 to form a U-shaped configuration to mate with corresponding upstanding walls of portion 124 such as walls 130 and 132 and so on as seen in FIG. 13 to form the external sides of the seal. A shoulder 182.is formed in front wall 180 for receiving the end of flange 170.

A bar code 184 is imprinted on the interior surface 186 of wall 180 facing portion 124. The portion 126 is transparent while the portion 124 may be opaque of a given color for the purpose described previously. The bar code 184 may be imprinted directly on surface 186 or may be imprinted on a label applied to surface 186 in a manner similar to that described in connection with the seal 10 of FIG. 1. In this case the adhesive is transparent and applied over the bar code on the label with the bar code facing surface 186.

The portions 124 and 126 are preferably secured by ultrasonic welding the ribs 134.and 156 to portion 126. The .ribs 156 abut the broad surface 186 of portion 126 while ribs 134 engage a mating surface of walls 176, 178 and so on of portion 126. In the alternative, walls 176, 178 and not shown bottom wall of portion 126 may be eliminated and the walls 130 and 132 (and not shown bottom walls) of portion 124 may be of the same height as the walls 136, 138 and so on of portion 124 so all of these walls engage the planar surface of portion 126 corresponding to surface 186. The operation of seal 120 is the same as seal 10 except the bar code 184 is not hermetically sealed.

In a further alternative embodiment, the ultrasonic welding ribs 156 on walls 136, 138 and 140, FIG. 14, may be omitted in a central region of these walls between the top and bottom walls so as to not interfere with the integrity of the bar code indicia on surface 186 of portion 126. In a still further embodiment, the bar code indicia 184 on surface 186 may be sealed with a hermetically sealing coating or layer such as an adhesive coated transparent film. The bar code indicia may be imprinted on such a film which film is then adhered to the surface 186.

While modifications may be made to the disclosed embodiments, such modifications are intended to be included wherein the scope of the invention is as defined in the appended claims.

What is claimed is:

1. A padlock type security seal comprising:

a shackle having at least one leg with a locking element;

a body with at least a transparent portion, said body having a first chamber therein in communication with the ambient atmosphere through an opening in the body in an axial direction, said chamber having a given width, depth and length, said length extending in the axial direction; and a locking insert secured to the body in said chamber, said insert comprising a rear wall with opposing broad sides and at least one rib upstanding from one of said opposing broad sides such that the one broad side and the at least one rib form a further chamber with said body in communication with said opening for receiving said at least one leg and to form a locking chamber in communication with the further chamber for receiving and locking said locking element therein, said rear wall on a side opposite said upstanding at least one rib comprising a planar surface for receiving indicia thereon and facing said transparent portion.

2. The seal of claim 1 further including a label with said indicia on a side thereof and means for securing the label to said insert planar surface.

3. The seal of claim 1 wherein the shackle includes a pair of said legs each with a locking element forming a pair of locking elements, said at least one rib forming a pair of said further chambers and a pair of said locking chambers, each locking chamber corresponding to a different one of said further chambers for receiving and engaging a different locking element, said pair of further chambers and pair of locking chambers each having a chamber first side formed by a rear wall broad side and having a chamber second side formed by the same side of said body.

4. The seal of claim 1 including means for hermetically sealing said indicia in said first chamber.

5. The seal of claim 4 wherein said means for hermetically sealing includes an annular rib upstanding from said rear wall planar surface and means for sealing said rib to said body in said first chamber.

6. The seal of claim 1 wherein said at least one rib comprises first and second upstanding walls extending in said axial direction to form a respective side of said further and said locking chambers and said at least one rib forms a third upstanding wall extending transverse said first and second walls in the first chamber width direction to form a locking wall engagable by said locking element and forming a fourth chamber with said first and second walls, said third wall being sufficiently thin as to be ruptured by said locking element when displaced toward said opening.

7. The seal of claim 1 wherein said rear wall on a broad side of said insert opposite the one side has a planar surface and a peripheral upstanding rib forming a recess with said planar surface for receiving indicia on said planar surface.

8. The seal of claim 1 wherein said planar surface overlies said at least one rib and said further and locking chambers.

9. The seal of claim 3 wherein each said legs are of different lengths, said upstanding at least one rib forming a first locking recess adjacent to said opening in communication with one of said further chambers and one of said locking chambers and spaced distal a second locking recess corresponding to the one locking chamber whereby the longer of said legs selectively engages the first and second locking recesses in accordance with its axial position in said one further chamber.

10. The seal of claim 1 wherein the body, first chamber and insert are each substantially rectangular of a given corresponding width, length in the axial direction and depth transverse the width and length, the body width being substantially greater than its depth forming a broad surface area with its length, the insert being dimensioned approximately slightly smaller than the body so as to occupy a substantially similar broad surface area as the body.

11. The seal of claim 10 wherein the body has broad surfaces facing corresponding insert broad surfaces in said first chamber, said insert broad surfaces being at least about 75% of the body broad surface area.

12. The seal of claim 1 wherein the first chamber has a given depth, said insert having a rear wall thickness about 30% the first chamber depth.

13. The seal of claim 3 wherein said at least one rib includes a U-shaped peripheral rib extending about said insert rear wall forming an outer side of said further chambers.

14. The seal of claim 3 wherein said at least one rib is about the same thickness and height throughout and comprises linear sections.

15. An insert for a padlock seal having a shackle formed of a wire with a pair of legs having spaced resilient locking elements, said seal including a body with a chamber of a given width, depth and length, said insert comprising:

a rear wall member having opposing sides and a periphery dimensioned to fully occupy the width and depth of said chamber;

a plurality of ribs upstanding from the rear wall member on one side thereof, said upstanding ribs forming first and second leg receiving channels and first and second locking channels for receiving a different one of said elements, said rear wall member being dimensioned to occupy at least most of the depth of said chamber; and indicia on said rear wall member on a side opposite said plurality of ribs overlying at least a portion of said channels.

16. The insert of claim 15 wherein the first and second channels extend from an insert end, said upstanding ribs forming a third locking channel in communication with the first leg receiving channel, the second locking channel being located medially from the insert end relative to the first and third locking channels.

17. The insert of claim 15 including an annular upstanding rib on said rear wall member on a side opposite the one side for enclosing the periphery of said indicia.

18. The insert of claim 17 including means for sealing the annular upstanding rib to said body in said chamber for hermetically sealing the indicia to said body in said chamber.

19. A padlock type security seal comprising:

a resilient U-shaped shackle having first and second legs each having a reversely bent leg end portion forming a locking element;

a transparent body having a first chamber therein in communication with the ambient atmosphere through an opening in the body in an axial direction, said chamber being formed by a pair of opposing broad body sides and a set of narrower body sides wherein the chamber has a depth, width and length; and a locking insert secured to the body in said chamber, said insert comprising a rear wall member with opposing broad sides and a plurality of ribs upstanding from one of said opposing broad sides to form a pair of further chambers with said one broad side and said body in communication with said opening for receiving a different one of said legs and to form a pair of locking chambers each in communication with a different further chamber for receiving and locking a different corresponding one of said locking elements therein, said rear wall member on a side opposite said upstanding ribs comprising a planar surface for receiving indicia thereon, said insert having a thickness, width and length corresponding to the respective depth, width and length of said body chamber, said planar surface overlying at least a portion of said further and locking chambers.

20. The seal of claim 19 wherein said plurality of ribs include a plurality of portions oriented parallel and normal to one another to form substantially rectangular further and locking chambers.

21. The seal of claim 20 including an additional locking chamber adjacent to said opening in communication with one of said further chambers, each said further chambers having a bottom wall formed by at least one of said rib portions transverse that chamber distal said opening.

22. The seal of claim 21 including a U-shaped peripheral rib upstanding from the insert rear wall member on said one broad side forming an outer further chamber wall for said further chambers, said bottom walls being normal to a portion of said outer further chamber wall.

23. The seal of claim 22 including a recess formed in the rear wall member on said planar surface, said recess comprising said planar surface and defined by an annular upstanding rib.

24. The seal of claim 19 including means for hermetically sealing the indicia in said first chamber.

25. The seal of claim 24 wherein said means for hermetically sealing the indicia includes means for providing a second chamber in said first chamber between said insert and said body and including means for securing the insert to the body in the first chamber with the indicia in said second chamber.

26. A security seal comprising a lock body having a cavity and an elongate fastening means, said fastening means including a shackle having at least one leg with a resilient reversely bent leg end portion which is adapted to be coupled to an object, said shackle lockably attached in said cavity to said lock body to fasten said object, said lock body including identification indicia hermetically sealed within said body cavity and a transparent portion enabling said identification indicia to be viewed externally from said device.

* * * * *